US009339924B2

(12) United States Patent
Friedrich

(10) Patent No.: US 9,339,924 B2
(45) Date of Patent: May 17, 2016

(54) HAMMER

(75) Inventor: Andreas Friedrich, Limburg (DE)

(73) Assignee: Black & Decker Inc., New Britain, CT (US)

( * ) Notice: Subject to any disclaimer, the term of this patent is extended or adjusted under 35 U.S.C. 154(b) by 798 days.

(21) Appl. No.: 13/555,526

(22) Filed: Jul. 23, 2012

(65) Prior Publication Data

US 2013/0025895 A1 Jan. 31, 2013

(30) Foreign Application Priority Data

Jul. 26, 2011 (GB) ..... 1112829.5

(51) Int. Cl.
*B25D 17/06* (2006.01)
*B25D 11/06* (2006.01)
*B25D 16/00* (2006.01)

(52) U.S. Cl.
CPC ..... *B25D 17/06* (2013.01); *B25D 2217/0015* (2013.01); *B25D 2250/245* (2013.01)

(58) Field of Classification Search
CPC ..... B25D 17/06; B25D 2250/245; B25D 2217/0015
See application file for complete search history.

(56) References Cited

U.S. PATENT DOCUMENTS 4,006,787 A * 2/1977 Rumpp et al. ..... 173/132
4,898,250 A * 2/1990 Neumaier et al. ..... 173/48
6,568,484 B1 * 5/2003 Schmid et al. ..... 173/201
6,666,284 B2 * 12/2003 Stirm ..... 173/97
2006/0237206 A1 * 10/2006 Schamberger et al. ..... 173/201
2006/0243467 A1 * 11/2006 Meixner et al. ..... 173/48
2006/0243468 A1 * 11/2006 Meixner et al. ..... 173/48
2009/0277659 A1 * 11/2009 Roelfs et al. ..... 173/201
2011/0303429 A1 * 12/2011 Kohlschmied et al. ..... 173/112
2013/0319709 A1 * 12/2013 Hecht et al. ..... 173/109

FOREIGN PATENT DOCUMENTS

DE 3526162 1/1987
EP 1157788 12/2008
WO 2007061101 5/2007
WO 2007141080 12/2007

* cited by examiner

*Primary Examiner* — Andrew M Tecco
(74) *Attorney, Agent, or Firm* — Adan Ayala

(57) ABSTRACT

A hammer mechanism including: a motor; a piston reciprocatingly driven by the motor; a ram reciprocatingly driven by the reciprocating piston via an air spring; a beat piece supported in an axially slideable manner within a beat piece support structure which, during the normal operation of the hammer mechanism, is repetitively struck by the ram and which transfers the impacts to a cutting tool when held by the tool holder; wherein the beat piece comprises a first impact surface and the beat piece support structure including a second impact surface, the first and second impact surfaces coming into contact with each other when the beat piece axially slides to its furthest position away from the ram; and wherein the shape of the two surfaces relative to each other is arranged so that there is a non-uniform amount of contact between the first and second surfaces around the longitudinal axis.

12 Claims, 6 Drawing Sheets

HAMMER

CROSS-REFERENCE TO RELATED APPLICATIONS

This application claims priority, under 35 U.S.C. §119(a)-(d), to UK Patent Application No. GB 11 128 29.5 filed Jul. 26, 2011, the contents of which are incorporated herein by reference in its entirety.

FIELD OF THE INVENTION

The present invention relates to a hammer drill, and in particular, to a hammer drill having a ram which is capable of repetitively striking a cutting tool via a beat piece.

BACKGROUND OF THE INVENTION

A typical hammer drill comprises a body in which is mounted an electric motor and a hammer mechanism. A tool holder is mounted on the front of the body which holds a cutting tool, such as a drill bit or a chisel. The hammer mechanism typically comprises a ram, slideably mounted in a cylinder, reciprocatingly driven by a piston via an air spring, the piston being reciprocatingly driven by the motor via a set of gears and a crank mechanism or wobble bearing. The ram in turn repeatedly strikes the end of the cutting tool via a beat piece. When the only action on the tool bit is the repetitive striking of its end by the beat piece, the hammer drill is operating in a hammer only mode.

Certain types of hammer drill also comprise a rotary drive mechanism which enables the tool holder to rotatingly drive the cutting tool held within the tool holder. In such constructions, the cylinder is the form of a rotatable spindle. This can be in addition to the repetitive striking of the end of the cutting tool by the beat piece (in which case, the hammer drill is operating in a hammer and drill mode) or as an alternative to the repetitive striking of the end of the cutting tool by the beat piece by switching off the hammer mechanism (in which case, the hammer drill is operating in a drill only mode).

EP1157788 discloses such a hammer drill.

During the operation of a hammer either in hammer only mode or in hammer and drill mode, when the cutting tool held by the tool holder is pressed against a work piece to cut the work piece, the reciprocating piston, driven by the motor, reciprocatingly drives the ram in order to repetitively strike the beat piece which in turn strikes the end of a cutting tool to cause the cutting tool to strike the work piece. When the cutting tool is removed from the work piece whilst the hammer drill is still activated, the piston continues to be reciprocatingly driven by the motor. However, it desirable to stop the ram from continuing to repetitively strike the beat piece as it will result in damaging the support structure for the beat piece and/or tool holder as the energy of the impacts are no longer being absorbed by the work piece.

One way of achieving this is to provide a ram catcher. US20090277659 describes such a ram catcher.

The beat piece of a hammer is mounted in a beat piece support structure which can be the cylinder or within a support structure mounted either within the cylinder or directly in the housing of the hammer, or a combination of these.

A prior art design of a hammer mechanism will now be described with reference to FIGS. 1 to 5.

Referring to FIG. 1, a hammer drill comprises a body 2 having a rear handle 4 moveably mounted to the rear of the body 2. The rear handle 4 comprises a centre grip section 90 and two end connection sections 92; 94, one end connection section being attached to one end of the centre grip section, the other end connection section being connected to the other end of the centre grip section. The handle 4 is connected to the rear of the body 2 by the two end connection sections 92, 94. The rear handle is constructed from a plastic clam shell 100 and a rear end cap 102 which is attached to the clam shell 100 using screws (not shown). The rear of the body is formed by three plastic clam shells 6, 70, 72 which attach to each other and to the remainder of the body 2 using screws (not shown).

An SDS tool holder 8 is mounted onto the front 10 of the body 2. The tool holder can hold a cutting tool 12, such as a drill bit. A motor (shown generally by dashed lines 48) is mounted within the body 2 which is powered by a mains electricity supply via a cable 14. A trigger switch 16 is mounted on the rear handle 4. Depression of the trigger switch 16 activates the motor in the normal manner. The motor drives a hammer mechanism (shown generally by dashed lines 46 in FIG. 1), which comprises a piston 204 reciprocatingly driven by the motor via a crank shaft 206 within a spindle 150, which in turn reciprocatingly drives a ram 152 via an air spring 170 which in turn strikes, via a beat piece 156, the end of the cutting tool 12. The motor can rotationally drive the spindle 150 via a bevel gear 200 and torque clutch 202. A mode change mechanism (not shown) can switch the hammer drill between three modes of operation, namely hammer only mode, drill only mode or hammer and drill mode. A rotatable knob 18 is mounted on the top of the body 2. Rotation of the knob 18 changes the mode of operation of the hammer drill in well known manner.

Referring to the FIG. 2, the spindle 150 has a longitudinal axis 154. In side of the spindle 150 is located the ram 152, forward of the piston 204, a beat piece 156, forward of the ram 152, a ram catcher located between the ram 152 and the beat piece 156 and a beat piece support structure.

The forward end 162 of the spindle 150 forms part of the tool holder 8. During normal use, the cutting tool 12 (shown in dashed lines in FIG. 2) is held within the forward end 162 of the spindle 50 by the tool holder. The cutting tool 12 is prevented from rotating relative to the spindle 50 whilst being capable of moving axially over a limited range of movement within the forward end 162 of the spindle 150 in well known manner.

The piston 204 is mounted directly in the rear of the spindle 150 and comprises an O ring 208 which locates in a groove formed around the main body of the piston and which provides an air tight seal between the piston and the inner wall of the spindle 150.

The ram 152 is mounted directly in the spindle 150 and comprises a main body 166 attached to an end cap 160, via a neck 168, of smaller diameter than the main body 166 of the ram 152, located at the forward end of the ram 152. The ram is circular in cross section in any plane which extends perpendicularly from the longitudinal axis 154 (which is co-axial with the longitudinal axis of the spindle 150 when the ram is located inside of the spindle) of the ram 152 along its length. The ram 152 comprises an O ring 158 which locates in a groove formed around the main body 166 of the ram and which provides an air tight seal between the ram 152 and the inner wall of the spindle 150. During normal operation of the hammer, the ram 152 is reciprocatingly driven by the piston 204 via an air spring 170 formed between the piston 204 and ram 152 in well known manner along the longitudinal axis 154. The air spring 170 between the ram 152 and the piston 204 is maintained by the air in the air spring 170 being prevented from escaping from (or air external of the air spring entering into) the space between the piston 204 and ram 152 due to the two O rings 208, 158.

The ram catcher comprises a rubber ring 214 which locates against the inner wall of the spindle 150 and is axially held in position inside of the spindle by being sandwiched between a ring retainer, comprising a circlip 216 and metal washer 218, and a metal tubular insert 210 of the beat piece support structure, both being located inside of the spindle 150. The rubber ring 214 provides a lip which projects radially inwardly into spindle 150 towards the longitudinal axis 154. The diameter of the aperture formed by the rubber ring 214 is less than that of the end cap 160 of the ram

152 but similar to that of the neck 168 of the ram 152. A series of holes 220 are formed around the circumference of the spindle rearward of the circlip 216 which each extend through the wall of the spindle 150.

During the normal operation of the hammer drill, when the cutting tool is engaged with a work piece, the ram 152 is reciprocatingly driven over a range of axial positions (one of which is shown in FIG. 2) inside of the spindle located to the rear of the ram catcher, the ram 152 being prevented from engaging the ram catcher due to the position of the beat piece 156. The ring 214 has no contact with any part of the ram 152 during the normal operation of the tool. When the ram 152 is able to move forward, due to the position of the beat piece, the end cap 160 engages with the rubber ring 214 and passes through the aperture due to the ring deforming, allowing the lip to flex to enable the cap 160 to pass through it. Once the cap 160 has passed through the ring 214, the lip returns to its original shape, locating in the neck 168 of the ram to hold the ram 152 stationary (as shown in FIGS. 3 and 4).

The beat piece 156 is supported by a beat piece support structure formed in part by the spindle 150 and in part by a support structure inside the spindle 150 comprising a metal tubular insert 210 sandwiched between an O ring 212 and the rubber ring 214 of the ram catcher. The beat piece 156 is circular in cross section in any plane which extends perpendicularly from the longitudinal axis 154 (which is co-axial with the longitudinal axis of the spindle 150 when the beat piece is located inside of the spindle) of the beat piece 156 along its length, the centre of the circular cross section being located on the longitudinal axis.

The beat piece 156 comprises a middle section 172, a front section 174 and a rear section 176.

The middle section 172 has a uniform diametered circular cross section along its length, the centre of the circular cross section being located on the longitudinal axis 154.

The rear section 176 has a uniform diametered circular cross section along its length, the centre of the circular cross section being located on the longitudinal axis 154. The rear end 240 of the rear section 176 is flat and is impacted by the cap 160 of the ram 152 during normal operation. The rear section 176 is joined to the middle section 172 via a first angled region 242. The first angled region 242 engages with a correspondingly shaped first angled shoulder 244 formed on the metal insert 210 located inside the spindle when the beat piece is in its most rearward position, limiting the amount of rearward movement of the beat piece 156. The wall of the angled shoulder 244 is circular in cross section in any plane which extends perpendicularly from the longitudinal axis 154 of the spindle 150, the centre of the circular cross section being located on the longitudinal axis. When the first angled region 242 is in engagement with the first angled shoulder 244, there is a uniform amount of contact between the two surfaces around the longitudinal axis 154.

The front section 174 is frusto conical in shape centred around the longitudinal axis 154 of the beat piece 156. The front end 246 of the front section 174 is flat and impacts the cutting tool 12 during normal operation. The front section 174 is joined to the middle section 172 via a second angled region 248 which is frusto conical in shape centred around the longitudinal axis 154 of the beat piece 156. The second angled region 248 engages with a correspondingly shaped second angled shoulder 250 formed on the inner wall of the spindle 150 when the beat piece is in its most forward position, limiting the amount of forward movement of the beat piece 156. The wall of the second angled shoulder 250 is circular in cross section in any plane which extends perpendicularly from the longitudinal axis 154 of the spindle 150, the centre of the circular cross section being located on the longitudinal axis 154. When the second angled region 248 is in engagement with the second angled shoulder 250, there is a uniform amount of contact between the two surfaces around the longitudinal axis 154.

When the hammer drill is operating in the normal manner with the cutting tool 12 cutting a work piece, the ram strikes the beat piece 156 which in turn strikes the end of cutting tool 12 in the tool holder 8. The ram 152 is reciprocatingly driven over a limited range of axial movement within the spindle, the maximum distance from the piston being limited by the position of the beat piece 156 which it impacts, the position of which in turn is controlled by the end of the cutting tool 12. Whilst traveling within this range of axial movement, the O ring 158 of the ram 152 does not pass the holes 220. As such, the air spring 170 between the piston 204 and ram 152 is maintained. The rear section 176 projects rearwardly through the aperture of the ring 214 of the ram catcher, to enable the cap 160 of the ram 152 to strike it as shown in FIG. 2.

When the cutting tool 12 is removed from the work piece, the beat piece 156 is able to move forward as the cutting tool 12 can extend out of the tool holder 8 to its maximum position. If the motor is still running, the piston 204 is able to drive the ram 152 via the air spring 170 further along the spindle 150, as the beat piece 156 can move forward, passing the air holes 220. Once the O ring 158 of the ram 152 has passed the air holes 220, the air is able to freely pass into and out of the spindle 150 in the space between the piston 204 and ram 152, causing the air spring 170 to be broken and thus disconnecting the drive between the piston 204 and ram 152. As the air spring 170 is broken, the ram 152 is able freely continue to travel along the length of the spindle 150. The ram 152 engages with the ram catcher, the cap 160 passing through the ring 214 allowing the neck 168 to engage with the ring, to secure the ram in the ram catcher, as seen in FIGS. 3 and 4. The reciprocating movement of the piston 204 has no effect on the ram 152 as the air spring 170 is broken due to the holes 220 which allow air in and out of the spindle 170 in the space between the piston 204 and ram 152. The beat piece 156 is pushed forward in the spindle 150 by the ram 152 in the ram catcher. In order to release the ram 152 from the ram catcher, the cutting tool 12 is pressed against a work piece causing it to be pushed into the tool holder 8, which in turn pushes the beat piece 156 rearwardly into engagement with the cap 160 of the ram 152, pushing it out of the ram catcher and past the holes 220. In such a position, the air spring 170 is reformed and the piston 204 is able to reciprocatingly drive the ram 152 again.

However, such a design suffers from a problem. When the ram 152 engages with the ram catcher, it pushes the beat piece 156 forward (see FIG. 3). The beat piece 156 travels to its furthest forward position (see FIG. 4) where the second angled region 248 engages with the second angled shoulder 250. However, upon engagement, the beat piece 156 is still traveling at speed and therefore, the second angled region 248 rebounds off the second angled shoulder 250. As there is a uniform amount of contact between the two surfaces around the longitudinal axis 154, the majority of the force within the rebound is in the same direction as the longitudinal axis 154 of the spindle 150, resulting the beat piece 156 traveling back towards and into engagement with the cap 160 of the ram 152. Such is the force of the impact of the beat piece on the cap 160 of ram 160, the cap 160 is pushed back through the ring 214, disengaging the ram 152 from the ram catcher and causing it to travel towards the piston 204, the O ring passing the holes 220 as it does so. This restores the air spring 170 and causes the ram to be reciprocatingly driven again by the piston 204.

BRIEF SUMMARY OF THE INVENTION

It is the object of the present invention to provide a design of beat piece and beat piece support structure which prevents the beat piece from disengaging the ram from the ram catcher due to rebound.

US2006/0237206 shows a beat piece and ram where the contact point between the two is off set from axis of the percussive axis.

Accordingly, there is provided a hammer drill comprising;

a housing;

a tool holder mounted on the housing which is capable of holding a cutting tool;

a motor mounted within the housing; and a hammer mechanism comprising:

a piston reciprocatingly driven along a longitudinal axis by the motor when the motor is actuated;

a ram reciprocatingly driven on the longitudinal axis by the reciprocating piston via an air spring;

a beat piece supported in an axially slideable manner on the longitudinal axis within a beat piece support structure which, during the normal operation of the hammer mechanism, is repetitively struck by the ram and which transfers the impacts to a cutting tool when held by the tool holder;

wherein the beat piece comprises a first impact surface and the beat piece support structure comprises a second impact surface, the first and second impact surfaces coming into contact with each other when the beat piece axially slides to its furthest position away from the ram;

characterized in that that the shape of the two surfaces relative to each other is arranged so that there is a non uniform amount of contact between the first and second surfaces around the longitudinal axis 154.

This results in the beat piece twisting slightly as it rebounds backwards after the two surfaces make contact with each other, increasing the frictional contact between the beat piece and beat piece support structure.

Preferably, there is provided a ram catcher located between the ram and the beat piece to hold the ram when it travels to it furthest position away from the ram. The twisting movement of the beat piece as it rebounds backwards after the two surfaces make contact with each other ensures that the beat piece has insufficient force to travel rearwardly enough to engage with the ram when located in the ram catcher or engages the ram with insufficient force to disengage it from the ram catcher. Preferably, there is further provided an air vent to break the air spring between the piston and the ram when the ram is held by the ram catcher.

Such a hammer mechanism can comprises hollow piston with the ram located within a cavity formed inside of the piston. Alternatively, it could be a flat piston located within a cylinder with the ram located in the cylinder forward of the piston. The beat piece support structure can also be located in part or as a whole within the cylinder. Alternatively, the cylinder it self could form part or all of the beat piece support structure. The ram catcher could also be located within the cylinder between the ram and the beat piece. At least one hole could be formed through the wall of the cylinder rearward of the ram catcher, to break the air spring between the ram and the piston when the ram is held by the ram catcher. The cylinder could be in the form of a spindle which is capable of being rotationally driven by the motor.

The first and second surfaces can surround the longitudinal axis and either can be frusto conical.

The first impact surface can be circular in cross section in any plane which extends perpendicularly from a first axis which is extends in a direction parallel to the longitudinal axis 154 of the spindle 150, the centres of the circular cross sections being located on the first axis; and the second impact surface can be circular in cross section in any plane which extends perpendicularly from the longitudinal axis 154 of the spindle 150, the centres of the circular cross sections being located on the longitudinal axis 154. In such a design, the first axis can be located in close proximity to the longitudinal axis.

Alternatively, the first impact surface can be circular in cross section in any plane which extends perpendicularly from the longitudinal axis 154 of the spindle 150, the centres of the circular cross sections being located on the longitudinal axis 154; and the second impact surface can be circular in cross section in any plane which extends perpendicularly from a second axis which is parallel to the longitudinal axis 154 of the spindle 150, the centres of the circular cross sections being located on the second axis. In such a design, the second axis can be located in close proximity to the longitudinal axis.

As a third alternative, the first impact surface can be circular in cross section in any plane which extends perpendicularly from a first axis which is extends in a direction parallel to the longitudinal axis 154 of the spindle 150, the centres of the circular cross sections being located on the first axis; and the second impact surface can be circular in cross section in any plane which extends perpendicularly from a second axis which is parallel to the longitudinal axis 154 of the spindle 150, the centres of the circular cross sections being located on the second axis. In such a design, the first and second axes can be located in close proximity to the longitudinal axis.

BRIEF DESCRIPTION OF THE DRAWINGS

Two embodiments of the invention will now be described, by way of example only and not in any limitative sense, with reference to the accompanying drawings, in which: —

DETAILED DESCRIPTION OF THE INVENTION

A first embodiment of the present invention will now be described with reference to FIG. 6.

Figure 6:
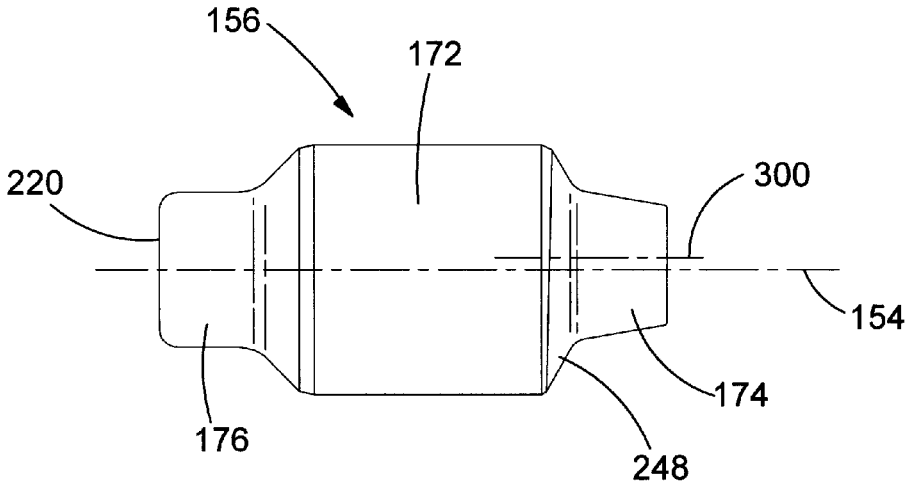
FIG. 6 shows a beat piece according to the first embodiment of the present invention.

FIG. 6 shows the new design of beat piece 156 in accordance with the present invention. Where the same features in the first embodiment are shown in the prior art example described above, the same reference numbers are used. The only difference between the prior art design and the first embodiment is the design of the beat piece only.

The rear section 176, first angled region 242 and middle section 172 of the beat piece 156 are the same as the prior art design and are circular in cross section in any plane which extends perpendicularly to the longitudinal axis 154 of the beat piece, the centre of each circular cross section being the longitudinal axis 154 of the beat piece 156.

However, the design of front section 174 and second angled region 248 has changed.

The front section 174 and second angled region 248 are both still frusto conical in shape and circular in cross section in any plane which extends perpendicularly to the longitudinal axis 154 of the beat piece. However, the centre of each circular cross section is not the longitudinal axis 154 of the beat piece 156 but a second axis 300 which runs parallel to the longitudinal axis but is located in close proximity to the longitudinal axis. This results in the front section 174 and second angled region 248 being eccentric relative to the longitudinal axis of the beat piece.

The second angled shoulder 250 formed on the inner wall of the spindle 150 is circular in cross section in any plane which extends perpendicularly from the longitudinal axis 154 of the spindle 150, the centre of the circular cross section being located on the longitudinal axis 154. When the beat piece is located inside the spindle the longitudinal axes 154 of the beat piece 156 and spindle 150 are co-axial. This results in the second axis 300 of the beat piece being off set relative to the longitudinal axis 154 of the spindle 150, resulting the front section 174 and second angled region being eccentric or off set relative to the longitudinal axis. This results in there being a non uniform amount of contact between the second angled region 248 and the second angled shoulder 250 around the longitudinal axis 154.

Figure 1:
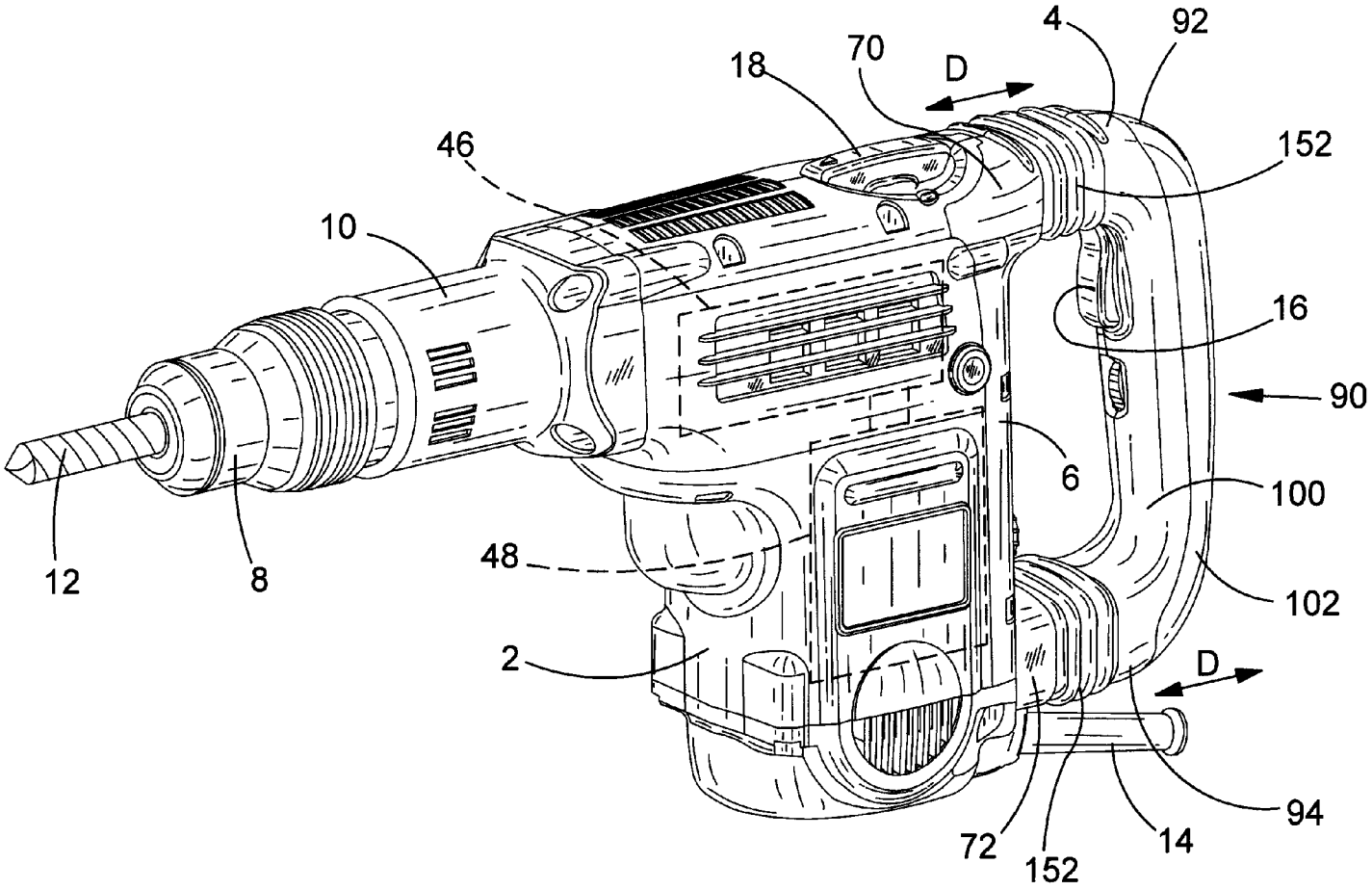
FIG.1 (PRIOR ART)
FIG. 1 shows a sketch of a side view of a prior art hammer drill.
Figure 2:
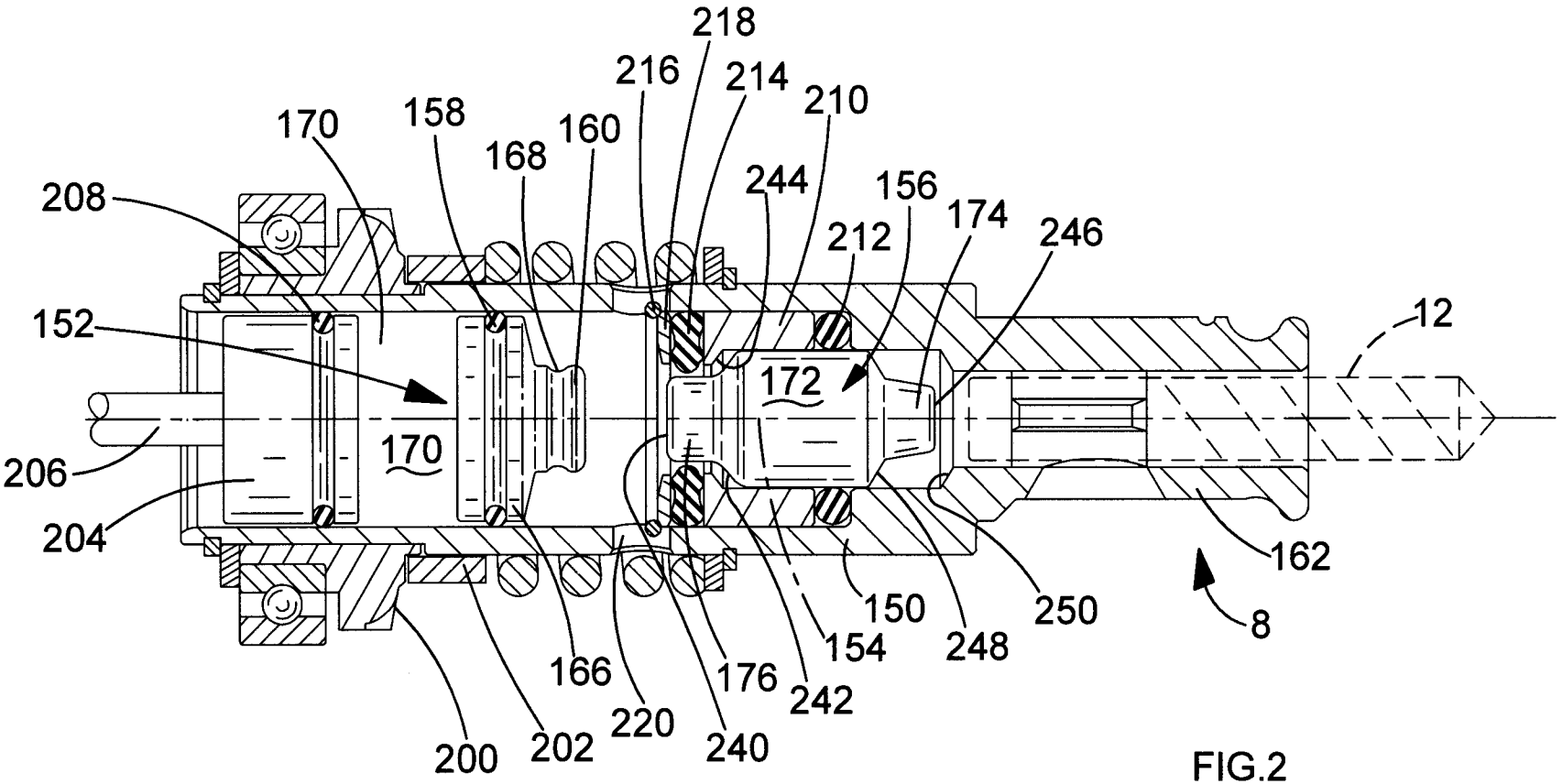
FIG.2 (PRIOR ART)
FIG. 2 shows a cross sectional view of the hammer mechanism with the ram in a position where it can freely slide within the spindle.
Figure 3:
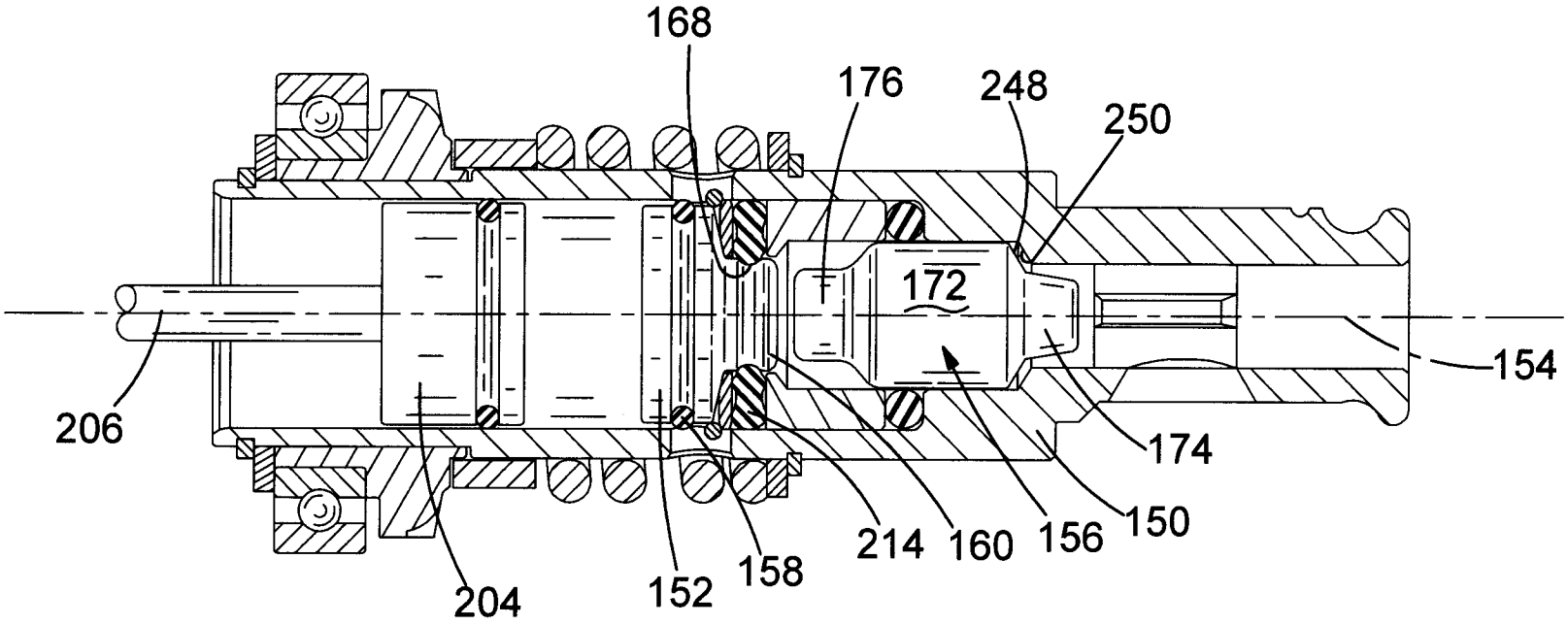
FIG. 3 shows a cross sectional view of the hammer mechanism with the ram in the ram catcher and the beat piece sliding in the spindle.
Figure 4:
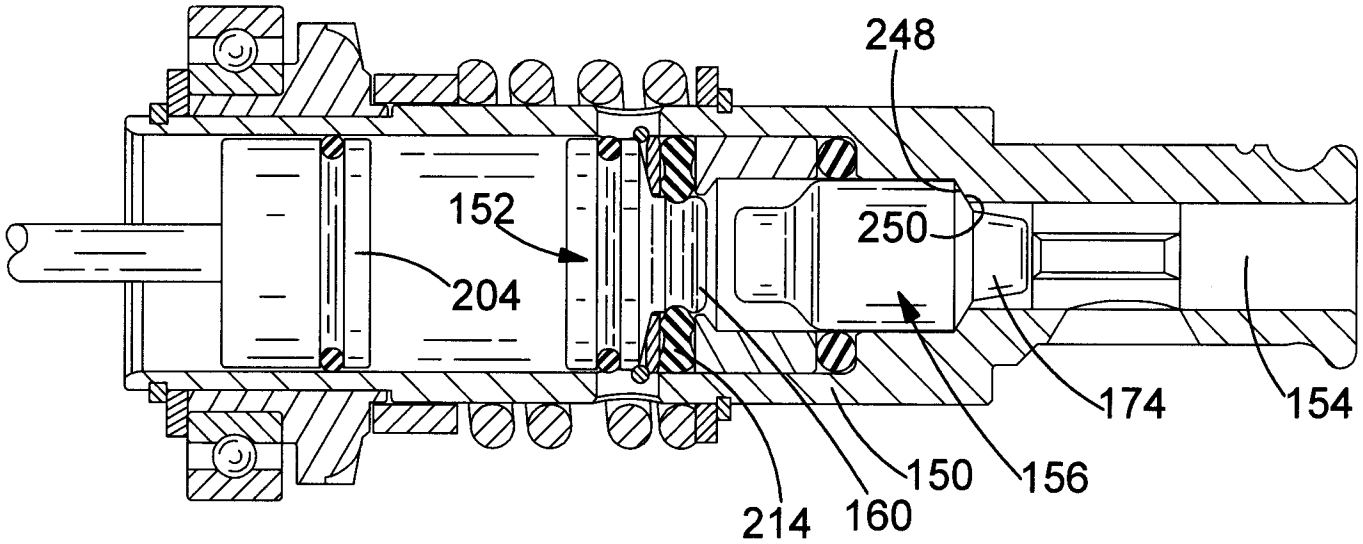
FIG. 4 shows a cross sectional view of the hammer mechanism with the ram in the ram catcher and the beat piece in its furthest forward position in the spindle.
Figure 5:
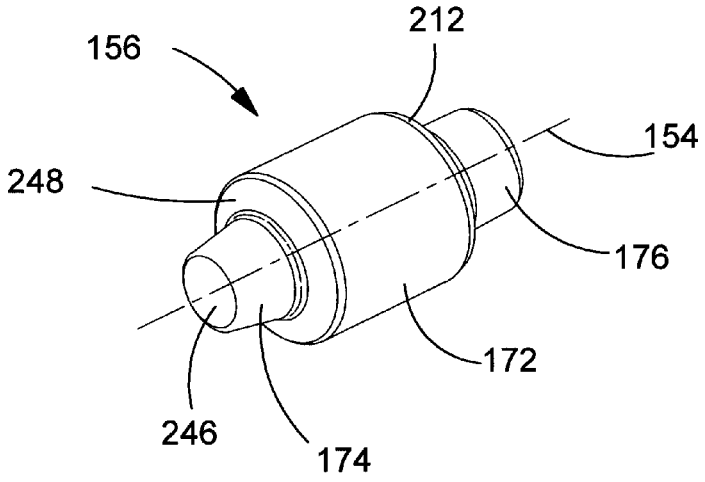
FIG. 5 shows the beat piece.

When the ram 152 engages with the ram catcher, it pushes the beat piece 156 forward (see FIG. 3). The beat piece 156 travels to its furthest forward position (see FIG. 4) where the second angled region 248 engages with the second angled shoulder 250. However, upon engagement, the beat piece is still traveling at speed and therefore, the second angled region 248 rebounds off the second angled shoulder 250. However, as the amount of contact between the two surfaces around the longitudinal axis 154 is no longer uniform, a proportion of the force within the rebound is a direction other than that of the longitudinal axis 154 of the spindle 150 eg sideways, resulting the beat piece 156 twisting slightly as it rebounds backwards, increasing the frictional contact between the beat piece 156 and beat piece support structure. As such, the beat piece either has insufficient force to travel rearwardly enough to engage the ram 152 or engages the ram with insufficient force to disengage it from the ram catcher.

A second embodiment of the present invention will now be described with reference to FIG. 7.

Figure 7:
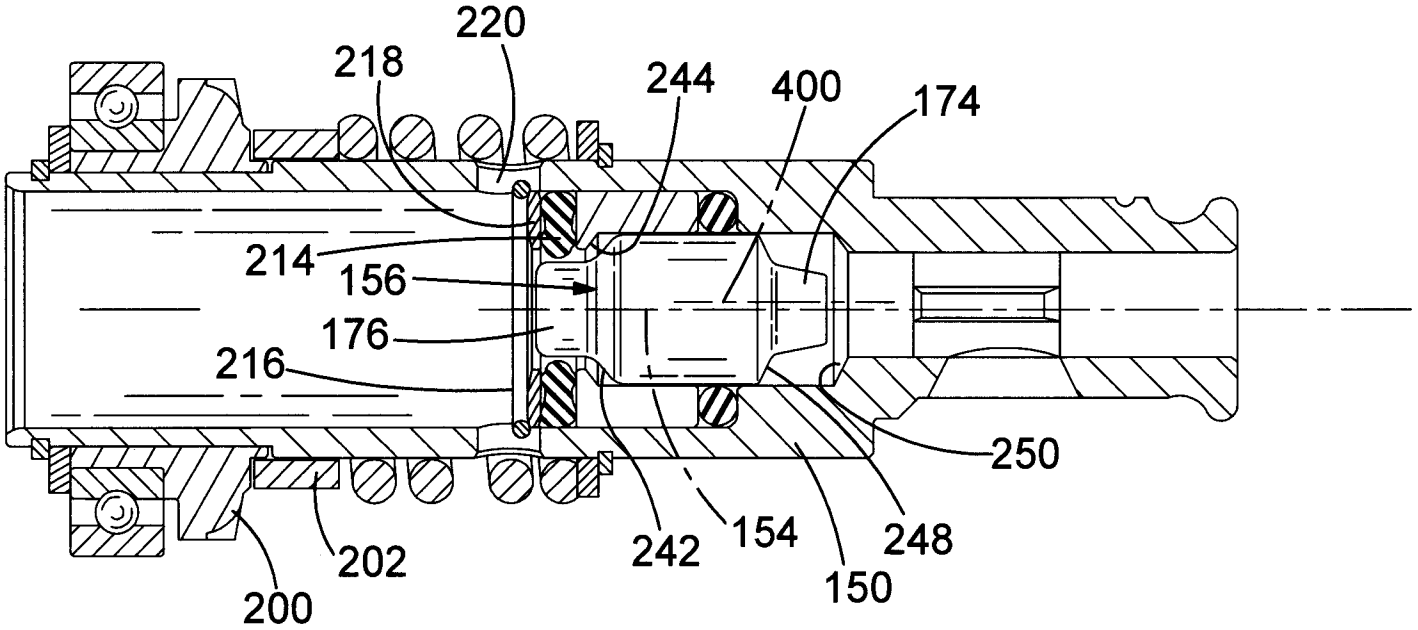
FIG. 7 shows a spindle according to the second embodiment of the present invention.

FIG. 7 shows the new design of spindle 150 in accordance with the present invention. Where the same features in the prior art description described previously are present in the second embodiment, the same reference numbers are used. The only difference between the prior art design and the second embodiment is the design of the spindle only.

As with the prior art design, the second angled shoulder 250 formed on the inner wall of the spindle 150 is circular in cross section in any plane which extends perpendicularly from the longitudinal axis 154 of the spindle 150. However, the centre of the circular cross sections is not located on the longitudinal axis 154 but on a third axis 400 which runs parallel to the longitudinal axis 154 but is located in close proximity to the longitudinal axis. This results in the second angled shoulder 250 being eccentric relative to the longitudinal axis 154 of the spindle 150. The beat piece remains the same design as the prior art design. This results in there being a non uniform amount of contact between the second angled region and the second angled shoulder around the longitudinal axis 154.

When the ram engages with the ram catcher, it pushes the beat piece forward (see FIG. 3). The beat piece 156 travels to its furthest forward position (see FIG. 4) where the second angled region 248 engages with the second angled shoulder 250. However, upon engagement, the beat piece is still traveling at speed and therefore, the second angled region 248 rebounds off the second angled shoulder 250. However, as the amount of contact between the two surfaces around the longitudinal axis 154 is no longer uniform, a proportion of the force within the rebound is a direction other than that of the longitudinal axis 154 of the spindle 150 e.g. sideways, resulting the beat piece 156 twisting slightly as it rebounds backwards, increasing the frictional contact between the beat piece and beat piece support structure. As such, the beat piece either has insufficient force to travel rearwardly enough to engage with the ram 152 or engages the ram with insufficient force to disengage it from the ram catcher.

It will be appreciated by the reader that both the second angled region (248) and the second angled shoulder (250) could be circular in cross section in any plane which extends perpendicularly from the longitudinal axis 154 of the spindle 150, but which are centred on axes which run parallel to the longitudinal axis, resulting in both the second angled region and the second angled shoulder being eccentric relative to the longitudinal axis 154 of the spindle 150.

The invention claimed is:

1. A hammer drill comprising:

a housing;

a tool holder mounted on the housing which is capable of holding a cutting tool;

a motor mounted within the housing; and a hammer mechanism comprising;

a piston reciprocatingly driven along a longitudinal axis by the motor when the motor is actuated;

a ram reciprocatingly driven on the longitudinal axis by the reciprocating piston via an air spring;

a beat piece supported in an axially slideable manner on the longitudinal axis within a beat piece support structure which, during the normal operation of the hammer mechanism, is repetitively struck by the ram and which transfers the impacts to a cutting tool when held by the tool holder;

wherein the beat piece comprises a first impact surface and the beat piece support structure comprises a second impact surface, the first and second impact surfaces coming into contact with each other when the beat piece axially slides to its furthest position away from the ram;

wherein the first impact surface is circular in cross-section in a first plane which extends perpendicularly from the longitudinal axis; such circular cross-section having a first center, and the second impact surface is circular in cross-section in a second plane which extends perpendicularly from the longitudinal axis, such circular cross-section having a second center, wherein the first and second centers are not on a same axis, and at least one of the first and second centers not being on the longitudinal axis.

2. The hammer drill of claim 1, further including a ram catcher located between the ram and the beat piece to hold the ram when the beat piece travels to its furthest position away from the ram.

3. The hammer drill of claim 2, further providing an air vent to break the air spring between the piston and the ram when the ram is held by the ram catcher.

4. The hammer drill of claim 1, wherein the first and second impact surfaces surround the longitudinal axis.

5. The hammer drill of claim 4, wherein the first impact surface is frusto-conical.

6. The hammer drill of claim 4, wherein the second impact surface is frusto-conical.

7. The hammer drill of claim 4, wherein the first center is located on a first axis which is parallel to the longitudinal axis.

8. The hammer drill of claim 7, wherein the first axis is located in close proximity to the longitudinal axis.

9. The hammer drill of claim 4, wherein the second center is located on a first axis which is parallel to the longitudinal axis.

10. The hammer drill of claim 9, wherein the first axis is located in close proximity to the longitudinal axis.

11. The hammer drill of claim 4, wherein the first center is located on a first axis which is parallel to the longitudinal axis; and the second center is located on a second axis which is parallel to the longitudinal axis.

12. The hammer drill of claim 11, wherein the first and second axes are located in close proximity to the longitudinal axis.

* * * * *